United States Patent [19]

Schreiber et al.

[11] 4,253,475

[45] Mar. 3, 1981

[54] WATER PIPES OR BONGS

[76] Inventors: Ronald J. Schreiber; Batya R. G. Schreiber, both of P. O. Box 7803, Ann Arbor, Mich. 48107

[21] Appl. No.: 841,350

[22] Filed: Oct. 12, 1977

[51] Int. Cl.[3] ..... A24F 1/30

[52] U.S. Cl. ..... 131/173; 131/198 R

[58] Field of Search ..... 131/173, 198 R, 227, 131/229

[56] References Cited

U.S. PATENT DOCUMENTS

| | | | |
|---|---|---|---|
| 1,690,609 | 11/1928 | Zane | 131/173 |
| 3,703,179 | 11/1972 | Nubca | 131/173 |
| 3,863,646 | 2/1975 | Kahler | 131/173 |
| 4,031,905 | 6/1977 | Dunn | 131/173 |

FOREIGN PATENT DOCUMENTS

| | | | |
|---|---|---|---|
| 107388 | of 1899 | Fed. Rep. of Germany | 131/173 |

*Primary Examiner*—Stephen C. Pellegrino

[57] ABSTRACT

An improved water pipe or bong wherein the water that is used to filter and cool the smoke is caused to flush up the inhalation tube, thus pushing the smoke into the smoker's lungs. To enhance the flushing effect a water trap is employed to stop the water suddenly and the combustion bowl can be sealed off from the rest of the pipe.

9 Claims, 2 Drawing Figures

WATER PIPES OR BONGS

BACKGROUND OF THE INVENTION

The hookah or water pipe has been used in the Mideast for centuries to smoke organic materials such as tobacco. Since some of the these substances burn harshly the water pipe is used to make smoking them a more palatable experience. The usual water pipe includes a water chamber located between the bowl, wherein the material being smoked in burned, and a mouthpiece so that the smoke is bubbled through the water thus being filtered and cooled.

Recently, an oriental variant of the water pipe known as a bong has gained popularity and is marketed presently. The classic bong has a single, vertical, elongate open pipe about 1½ inch in diameter sealed at the bottom, the open upper end placed against the face about the mouth of the smoker, a bowl for burning the organic substance and a single tube mounting the bowl and leading at an angle into the elongate pipe near the bottom of the pipe. Water is placed into the elongate pipe to a level just above the junction of the open pipe and the bowl tube so that when the smoker draws on the pipe, smoke is bubbled through the water to cool and clean it. The smoke is further cooled by expanding in the wide elongate pipe. Thus the elongate pipe operates as a combined water and inhalation chamber. To facilitate inhaling the smoke from the chamber, a "shotgun" or small diameter hole is located in the elongate pipe just above the water level and kept closed by the smoker's finger during the initial stages of a smoke. When the elongate pipe is filled with smoke, the hole is opened and the smoke drawn into the lungs.

Recently, an oriental variant of the water pipe known as a bong has gained popularity and is marketed presently. The classic bong has a single, vertical, elongate open pipe about 1½ inch in diameter sealed at the bottom, the open upper end placed against the face about the mouth of the smoker, a bowl for burning the organic substance and a single tube mounting the bowl and leading at an angle into the elongate pipe near the bottom of the pipe. Water is placed into the elongate pipe to a level just about the junction of the open pipe and the bowl tube so that when the smoker draws on the pipe, smoke is bubbled through the water to cool and clean it. The smoke is further cooled by expanding in the wide elongate pipe. Thus the elongate pipe operates as a combined water and inhalation chamber. To facilitate inhaling the smoke from the chamber, a "shotgun" or small diameter hole is located in the elongate pipe just above the water level and kept closed by the smoker's finger during the initial stages of a smoke. When the elongate pipe is filled with smoke, the hole is opened and the smoke drawn into the lungs.

A single bong is disclosed in the prior patented art. U.S. Pat. No. 3,881,499 discloses a bong wherein there is a water chamber located above, rather than below, an ash trap, and including extensive cooling tubes that go from the ash trap to different levels in the water chamber whereby one or more of the tubes are operative depending upon the strength of the draw.

None of the afforementioned prior art water pipes or bongs disclose a bong wherein the water that is used to filter and cool the smoke is caused to flush up the inhalation tube thus pushing the smoke into the smoker's lungs and thereby reducing the effort needed to draw the smoke into the lungs, and employing a water trap to prevent the water from reaching the smoker's mouth as well as a valve to seal off the combustion bowl from the rest of the bong while the water is flushed.

SUMMARY OF THE INVENTION

It is a primary object of the invention to provide a bong wherein the water used for cooling and cleaning the smoke can be caused to flush up the inhalation chamber thus pushing the smoke into the smoker's lungs and thereby easing the drawing of smoke into the lungs.

It is another object of the invention to provide a bong wherein the water used for cooling and cleaning the smoke can be caused to flush up the inhalation chamber thus pushing the smoke into the smoker's lungs and also having a combustion bowl that can be sealed off from the rest of the system while the water is flushing so as to prevent water from entering the bowl and to prevent the entry of air into the system by way of the bowl.

It is yet another object of the invention to provide a bong wherein the water used for cooling and cleaning the smoke can be caused to flush up the inhalation chamber thus pushing the smoke into the smoker's lungs and also having a water trap located in the upper half of the inhalation tube to prevent the water from reaching the smoker's mouth and allow the water to drain back to its original location at a controlled rate after the smoke is completed.

It is a further object of the invention to provide a bong having a reservoir of water that has an air intake and is connected to the water in the inhalation chamber in such a way that when the combustion bowl is sealed off from the system, drawing on the pipe will result in water flushing up the inhalation tube.

It is yet a further object of the invention to provide a bong wherein the water used for cooling and cleaning the smoke can be caused to flush up the inhalation chamber thus pushing the smoke into the smoker's lungs and having a water trap located in the upper half of the inhalation chamber to prevent the water from reaching the smoker's mouth and allow the water to drain back to its original location at a controlled rate and having a means for sealing off the combustion bowl from the system while the water is flushing and having the components of the bong easily removed in order to facilitate the cleaning of the bong.

It is an object of the invention to provide a bong having a main tube with three sections, the three sections being the inhalation tube, the connecting tube and the reservoir/air intake tube.

It is still another object of the invention to provide a bong having a main tube with three sections, the three sections being assembled in the approximate shape of the letter "j".

A further object of the invention is to provide a bong wherein the main tube is made of three sections assembled in the approximate shape of the letter "j" and being filled with water to a level in the inhalation tube and reservoir tube that is at least one inch above the upper edges of the junctions of these tubes and the connecting tube so that when the smoker inhales sharply, the water flushes up the inhalation tube.

Yet another object of the invention is to provide a bong having a water trap comprised of a series of funnels and inverted cones: the first, lower funnel is located about halfway up the inhalation tube and is sealed around the inner surface of the tube so as to allow water to pass through the hole in the funnel only, a cone located just above the funnel whose outer diameter is slightly smaller than the outer diameter of the funnel so that smoke may pass the cone but most of the water is splashed back down into the funnel, as well as a second funnel and cone set located about five inches above the first and being identical to the first with the exception of having an additional cone located just below the funnel.

Yet a further object of the invention is to provide a bong with a combustion bowl that can be sealed from the system, this being effected by using a combination bowl and valve made of brass or ceramic material and screw mounted on and supported by a pipe stem leading to the connecting tube where it is screw mounted.

It is yet another object of the invention to provide a bong with a flexible hose leading, within the walls of the bong, from the pipe stem to the water in the inhalation tube so that smoke may be bubbled through the water and drawn up the inhalation tube when the smoker draws on the pipe.

Further novel features and other objects of this invention will become apparent from the following detailed description, discussion and the appended claims taken in conjunction with the accompanying drawings.

BRIEF DESCRIPTION OF DRAWINGS

Preferred structural embodiments of this invention are disclosed in the accompanying drawings in which.

DESCRIPTION OF THE PREFERRED EMBODIMENTS

Figures 1, 2:
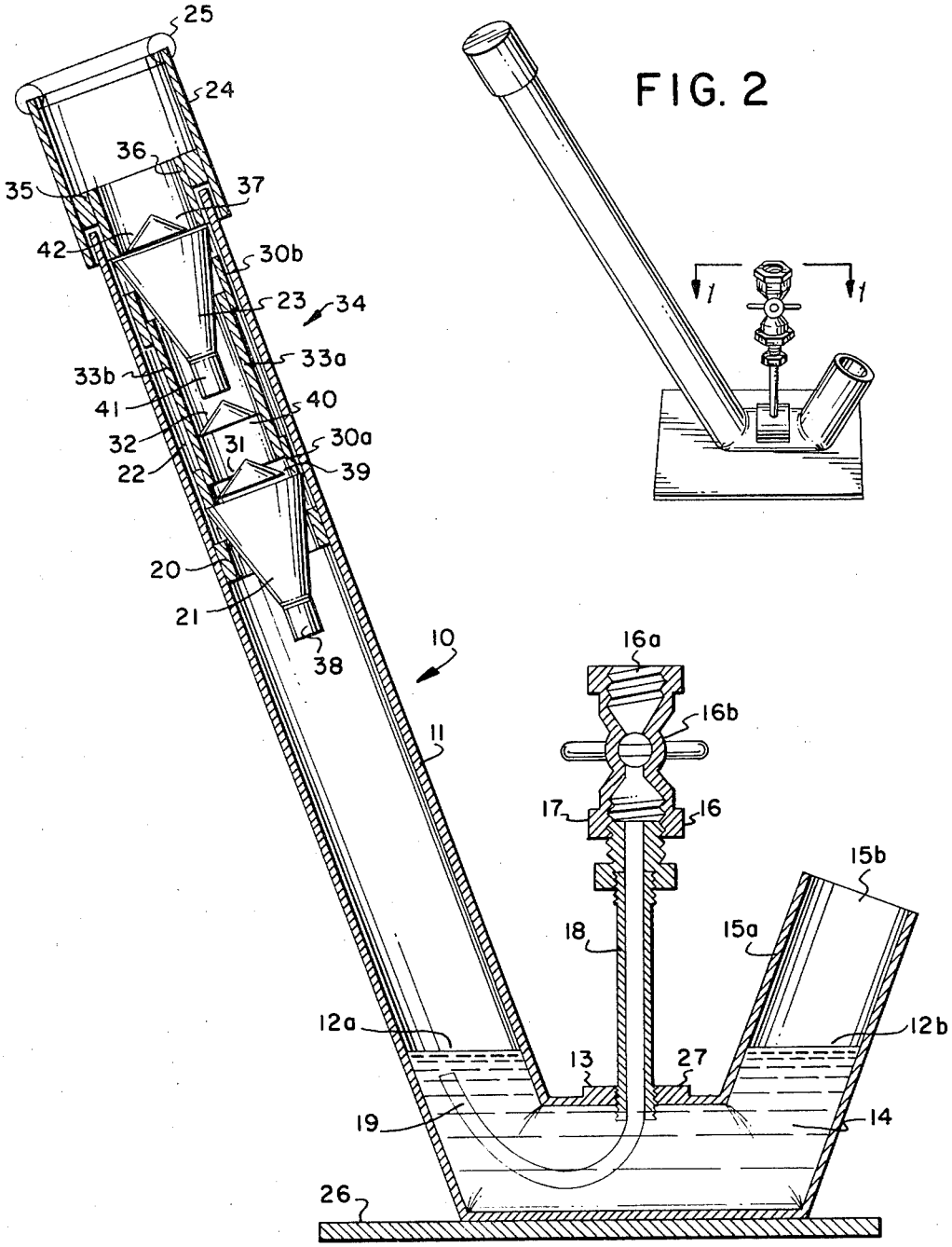
FIG. 1 is a cross sectional drawing of the bong as indicated by the dotted line, 1, in FIG. 2.
FIG. 2 is a perspective view of the bong.

A bong 10 in the preferred embodiment of the invention is constructed to rest in a stable, upright position on its base 26. The bong 10 is divided into an inhalation chamber means 11, partially filled with water or other liquid 14 to the level indicated at 12*a*, a central fluid communication chamber means 13 joined to the lowere end of chamber 11, a air intake chamber means 15*a* partially filled with water to the level indicated at 12*b* and an air intake opening 15*b* located at the upper end of chamber 15*a* (FIG. 1). Chamber 15*a* is joined at its lower end to chamber 13. The three main chambers are constructed in a unitary fashion for strength and to ease cleaning the pipe.

The substance to be burned is placed in the bowl 16*a* section of bowl/valve assembly 16, valve 16*b* is opened, air intake opening 15*b* is covered with the palm of the smoker's hand and as the smoker draws, smoke is conveyed to the water 14 in chamber 11 by way of flexible hose 19. and pipe stem 18. Stem 18 is screw mounted into a reinforced area 27 of the upper side of chamber 13 and can be removed for cleaning. As a result of low air pressure above the water level at 12*b* the smoke is drawn out of tube 19, bubbling up through and cooled by the water before passing into and filling chamber 11.

When chamber 11 is filled with smoke valve 16*b* is closed with the smoker's free hand. After this is done air intake opening 15*b* is opened suddenly as the smoker draws sharply on the pipe. As a result of a dramatic difference in pressure at the two surfaces of the water, the water flushes up the inhalation tube where it is stopped by water trap 34. The smoke, being able to pass through water trap 34, is pushed by the water into the mouth and lungs of the smoker via the mouthpiece end 25.

The combined bowl/valve assembly 16 is screw mounted onto the upper end of stem 18. Bushing 17 is located between stem 18 and bowl/valve assembly 16. Bushing 17 is used to isolate the torque load from stem 18 when bowl/valve assembly 16 is removed for cleaning.

Referring now to FIG. 1, water trap 34 is shown as being a series of funnels and inverted cones. Funnel 21 has an outer diameter which is the same as the inner diameter of chamber 11. Funnel 21 rests on ring 20 which is cemented to the inner surface of chamber 11. Located above funnel 21 is baffle assembly 22 which, as best shown in FIG. 1, is constructed of a lower ring 30*a* and an upper ring 30*b*, strut 33*a* and strut 33*b*, and cones 31 and 32. The outer diameters of rings 30*a* and 30*b* are slightly smaller than the inner diameter of chamber 11 while the outer diameters of cones 31 and 32 are smaller than the inner diameters of rings 30*a* and 30*b*. Rings 30*a* and 30*b* as well as cones 31 and 32 are mounted on struts 33*a* and 33*b* making assembly 22 structurally sound. Baffle assembly 22 may be removed to facilitate cleaning. Resting on ring 30*b* is funnel 23 which is identical to funnel 21.

Mouthpiece 24, which as best seen in FIG. 1, is constructed of a section of tubing that has an inner diameter which is the same as the outer diameter of chamber 11. This allows the mouthpiece to slide over the upper end of chamber 11. Mounted to the inner surface of mouthpiece 24 is ring 35. Ring 35 has the same inner and outer diameters as chamber 11 and locates mouthpiece 24 on the bong. Ring 36 mounts to the inner surface of ring 35. Ring 36 serves to press and seal funnel 23 against ring 30*b* and as a mounting location for cone 37. Cone 37 has an outer edge which is elliptical in shape. The largest dimension of the ellipse is the same as 24 and the mouth of the smoker.

As a result of the gaseous nature of smoke, it may easily pass through openings 38,39,40,41 and 42. However, when the water is flushed up chamber 11 most it is stopped by the underside of funnel 21. Some water does pass through opening 38 but most of this water is splashed back into the funnel by cone 31. A small portion of water usually passes through opening 39 yet most of this water is splashed downward by cone 32. The upper tip of cone 32 is located just below opening 41, preventing much of the remaining water from reaching said opening. Whatever water manages to enter funnel 23 is splashed downward by cone 37.

A significant feature in the construction of water trap 34 is that the downward slopes of the upper surfaces of said funnels and cones allow the water 14 to drain back into the lower section of the bong 10 at a controlled.

Preferably, all components, with the exception of funnel 21, funnel 23, mouthpiece cushion 25, bowl assembly 16, bushing 17, stem 18 and tube 19 of bong 10 are made of a durable synthetic material such as polycarbonate plastic. Polycarbonate is preferred to acrylic tubing in order to assure strength and to avoid crazing or cracking.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A water pipe or bong comprising an inhalation chamber means, an air intake chamber means; and a free flow fluid communication chamber means having fluid therein intermediate said inhalation and air intake chamber means; the fluid within said fluid chamber means having a first surface within said air intake chamber means and a second surface area, within said inhalation chamber means; a bowl for burning a substance to be smoked; tubular means for directing smoke from said bowl to the water in said combustion chamber means, said tubular means having an effective cross sectional area considerably smaller then the cross sectional area of said air intake chamber means; whereby during the first stage by operation of the bong, said air intake chamber means is closed to allow smoke to be drawn from said bowl through said tubular means and said fluid communication chamber means into said inhalation chamber means; whereby during the second and consummatory stage of the operation of the bong, said inhalation chamber means is filled with smoke and the smoker draws harder and suddenly opens said air intake chamber means while simultaneously inhaling sharply thereby causing an air pressure differential between the two surface areas of the water which causes said water to flush up said inhalation chamber means thus forcing the smoke into the smoker's lungs; water trap means within said inhalation chamber means to prevent the water flushed up said inhalation tube from entering the smoker's lungs.

2. The bong as recited in claim 1 including a means for preventing air from entering the bong by way of the bowl; whereby during the second and consummatory stage of operation the bong can be sealed off from the outside atmosphere thereby permitting maximum possible air pressure differential and maximum ram effect; said means located on said tubular means 3. The bong as recited in claim 1, wherein said water trap means comprises at least one baffle set having both a funnel, wherein the largest diameter of said funnel is the same as the inner diameter of said inhalation chamber means and an inverted hollow cone located just above said funnel wherein the largest diameter of said cone is slightly smaller than the inner diameter of said inhalation chamber means; said funnel arranged in said inhalation chamber means with is smallest diameter directed toward said fluid communication chamber means whereby most of said flushing water is splashed downward by the lower surface of the funnel and water that passes through the opening in said smallest diameter end of said funnel is splashed downward by said inverted cone.

4. The bong as recited in claim 1, including a base on said bong of sufficient dimensions to assure said bong's free-standing stability.

5. The bong as recited in claim 1, wherein said inhalation chamber means, said air intake chamber means and said fluid communication chamber means are fabricated of different lengths of the same diameter tubing and bonded together to result in a unitary structure.

6. The bong asrecited in claim 5, wherein said inhalation chamber, said fluid communication chamber means and said air intake means made of tubing of differing diameters thereby changing the amount of hydraulic pressure generated in the operation of said bong.

7. The bong as recited in claim 1, wherein said inhalation chamber means, said air intake chamber means and said fluid communication chamber means are fabricated of different lengths of the same diameter tubing and constructed such that the fluid communication chamber is mounted horizontally on said base and said inhalation chamber means and said air intake chamber means are mounted to the two ends of the fluid communication chamber in the perpendicular plane to said base and at angles to the fluid communication tube of between 90° and 135°.

8. The bong as recited in claim 7, wherein said tubing is made of a high strength plastic material such as polyvinyl chloride (p.v.c.), polymethyl methacrylate (acrylic) or polycarbonate.

9. The bong as recited in claim 1, wherein said inhalation chamber means, said air intake chamber means and said fluid communication chamber means are fabricated using a single piece of injection molded plastic.

* * * * *